US010676316B2

(12) United States Patent
Aitamurto et al.

(10) Patent No.: US 10,676,316 B2
(45) Date of Patent: Jun. 9, 2020

(54) METHOD, ELEVATOR CONTROL UNIT, AND ELEVATOR SYSTEM FOR DYNAMICALLY ADJUSTING A LEVELLING SPEED LIMIT OF AN ELEVATOR CAR

(71) Applicant: KONE Corporation, Helsinki (FI)

(72) Inventors: Juha-Matti Aitamurto, Helsinki (FI); Antti Hovi, Helsinki (FI); Ari Jussila, Helsinki (FI); Ari Kattainen, Helsinki (FI)

(73) Assignee: KONE CORPORATION, Helsinki (FI)

( * ) Notice: Subject to any disclaimer, the term of this patent is extended or adjusted under 35 U.S.C. 154(b) by 429 days.

(21) Appl. No.: 15/637,218

(22) Filed: Jun. 29, 2017

(65) Prior Publication Data

US 2018/0037436 A1 Feb. 8, 2018

(30) Foreign Application Priority Data

Aug. 2, 2016 (EP) ..... 16182357

(51) Int. Cl.

| | |
|---|---|
| ***B66B 1/24*** | (2006.01) |
| ***B66B 1/44*** | (2006.01) |
| ***B66B 1/28*** | (2006.01) |
| ***B66B 1/40*** | (2006.01) |
| ***B66B 5/04*** | (2006.01) |

(52) U.S. Cl.

CPC ..... *B66B 1/2416* (2013.01); *B66B 1/285* (2013.01); *B66B 1/405* (2013.01); *B66B 1/44* (2013.01); *B66B 5/04* (2013.01)

(58) Field of Classification Search

CPC B66B 1/40; B66B 1/2416; B66B 1/44; B66B 1/285; B66B 1/405

USPC ..... 187/286

See application file for complete search history.

(56) References Cited

U.S. PATENT DOCUMENTS

| | | | | | |
|---|---|---|---|---|---|
| 2,363,302 | A | * | 11/1944 | Eames | B66B 1/32 187/288 |
| 3,170,104 | A | * | 2/1965 | Richards | B66B 5/06 318/146 |
| 3,678,355 | A | * | 7/1972 | Bucek | B66B 1/30 318/756 |
| 3,826,928 | A | * | 7/1974 | Bucek | B66B 1/30 327/172 |
| 4,094,385 | A | * | 6/1978 | Maeda | B66B 1/50 187/291 |

(Continued)

FOREIGN PATENT DOCUMENTS

EP 2 886 501 A1 6/2015

OTHER PUBLICATIONS

European Search Report for EP 16 18 2357, dated Feb. 6, 2017.

*Primary Examiner* — David S Warren

(74) *Attorney, Agent, or Firm* — Birch, Stewart, Kolasch & Birch, LLP

(57) ABSTRACT

A method for dynamically adjusting a levelling speed limit of an elevator car during a levelling operation includes obtaining an indication that the elevator car is detected to arrive to a zone; obtaining at least one value indicating the speed of the elevator car, in response to detecting that the elevator car arrives to the zone; and dynamically adjusting the levelling speed limit of the elevator car based on the speed of the elevator car. An elevator control unit and a system are provided to perform at least partly the method.

20 Claims, 3 Drawing Sheets

(56) References Cited

U.S. PATENT DOCUMENTS

| | | | | |
|---|---|---|---|---|
| 4,101,007 | A * | 7/1978 | Magee | B66B 5/10 187/280 |
| 4,220,221 | A * | 9/1980 | Gingrich | B60L 3/08 187/295 |
| 5,612,517 | A * | 3/1997 | Johansson | B66B 1/24 187/285 |
| 5,677,519 | A | 10/1997 | Herkel et al. | |
| 2004/0173413 | A1 | 9/2004 | Angst et al. | |
| 2008/0128217 | A1 | 6/2008 | Kattainen et al. | |
| 2016/0318734 | A1 | 11/2016 | Müller et al. | |
| 2018/0037436 | A1* | 2/2018 | Aitamurto | B66B 1/2416 |
| 2018/0186600 | A1* | 7/2018 | Kramer | B66B 5/0031 |
| 2018/0201479 | A1* | 7/2018 | Taudou | B66B 13/16 |
| 2018/0237261 | A1* | 8/2018 | Herkel | B66B 5/0031 |

* cited by examiner

METHOD, ELEVATOR CONTROL UNIT, AND ELEVATOR SYSTEM FOR DYNAMICALLY ADJUSTING A LEVELLING SPEED LIMIT OF AN ELEVATOR CAR

TECHNICAL FIELD

The invention concerns in general the technical field of an elevator technology. Especially the invention concerns enhancing the safety of the elevators.

BACKGROUND

Typically an elevator comprises an elevator car and a hoisting machine configured to drive the elevator car in an elevator shaft between landings. When the elevator car is arriving to a landing, the elevator car is instructed to decelerate and finally to stop to the landing. To improve the accuracy of stopping the elevator car at the landing a levelling operation is used.

During the levelling operation the elevator car is allowed to move with open door(s) at an unlocking zone. However, the levelling speed of the elevator car is limited within the unlocking zone. The unlocking zone is typically defined as a zone extending from above and below a floor level of the landing, in which the elevator car floor must be in order to enable the door(s) to be unlocked. Both the car door(s) and landing door(s) may be unlocked during the levelling operation at the unlocking zone. The speed of the elevator car is also limited during a re-levelling of the elevator car. The re-levelling is an operation that is performed after the elevator car is stopped, to allow the stopping position of the elevator car to be corrected during loading or unloading, if necessary.

The speed limits for levelling and re-levelling are defined by standards. For example in EN 81-1 and EN 81-20 the speed limit for levelling with door(s) open is 0.8 m/s and for re-levelling with door(s) open is 0.3 m/s. According to another example in A17.1 standard the speed limit for levelling and re-levelling with door(s) open is 0.75 m/s. Furthermore, according to Unintended Car Movement Protection (UCMP) requirement the elevator car shall be stopped within a predetermined distance from the landing, if the elevator car moves away from the unlocking zone with open door(s).

According to prior art solutions, a fixed levelling speed limit value is set for the elevator car. If the speed of the elevator car meets the fixed levelling speed limit value during the levelling operation, the speed of the elevator car is configured figured to be decelerated or the movement of the elevator car is configured to be stopped.

However, one drawback of the prior art solution is that the stopping of the elevator car within the predetermined distance from the landing may be challenging or even impossible. Especially, if the elevator car moves away from the landing and leaves the unlocking zone at a speed that is close to the levelling speed limit. Thus, the higher the levelling speed limit is the longer the time to react to an unusual movement of the elevator car is.

Hence, there is a need to develop further solutions in order to mitigate the described drawbacks at least partly.

SUMMARY

An objective of the invention is to present a method, an elevator control unit, and an elevator system for dynamically adjusting a levelling speed limit of an elevator car during a levelling operation. Another objective of the invention is that the method, and elevator control unit, and elevator system for dynamically adjusting a levelling speed limit of an elevator car during a levelling operation improve at least partly the safety of an elevator solution.

The objectives of the invention are reached by a method, an elevator control unit, and an elevator system as defined by the respective independent claims.

According to a first aspect, method for dynamically adjusting a levelling speed limit of an elevator car during a levelling operation is provided, wherein the method comprising: obtaining an indication that the elevator car is detected to arrive to a zone; obtaining at least one value indicating the speed of the elevator car, in response to detecting that the elevator car arrives to the zone; and dynamically adjusting the levelling speed limit of the elevator car based on the speed of the elevator car.

The at least one value for indicating the speed of the elevator car may be obtained from at least one of the following: position sensor, drive, acceleration sensor, a magnetic sensor of door zone sensor unit.

The method may further comprise: determining if the speed of the elevator car meets the dynamically adjusted levelling speed limit of the elevator car; and controlling the movement of the elevator car, if the speed of the elevator car is determined to meet the dynamically adjusted levelling speed limit of the elevator car.

Alternatively or in addition, the at least one value indicating the speed of the elevator car may be a position of the elevator car and the method may further comprise: obtaining an indication if the position of the elevator car is determined to be outside the zone; determining if at least one door is open; and stopping the movement of the elevator car, if the position of the elevator car is determined to be outside the zone and the at least one door is determined to be open.

The zone may be an unlocking zone, wherein the unlocking zone is a zone extending from an upper limit above a floor level of a landing and a lower limit below the floor level of the landing, in which the elevator car floor is in order to enable at least one door to be unlocked.

The indication that the elevator car is detected to arrive to the zone may be obtained from a door zone sensor unit.

According to a second aspect, an elevator control unit for dynamically adjusting a levelling speed limit of an elevator car during a levelling operation is provided, wherein the elevator control unit comprising: at least one processor, and at least one memory storing at least one portion of computer program code, wherein the at least one processor being configured to cause the elevator control unit at least to perform: obtain an indication that the elevator car is detected to arrive to a zone; obtain at least one value indicating speed of the elevator car, in response to detecting that the elevator car arrives to the zone; and dynamically adjust the levelling speed limit of the elevator car based on the speed of the elevator car.

The elevator control unit may be configured to obtain the at least one value indicating the speed of the elevator car from at least one of the following: position sensor, drive, acceleration sensor, magnetic sensor of door zone sensor unit; which is communicatively coupled to the control unit.

The elevator control unit may be further configured to: determine if the speed of the elevator car meets the dynamically adjusted levelling speed limit of the elevator car; and control the movement of the elevator car, if the speed of the elevator car is determined to meet the dynamically adjusted levelling speed limit of the elevator car.

Alternatively or in addition, the at least one value indicating the speed of the elevator car may be a position of the elevator car and the elevator control unit may be further configured to: obtain an indication if the position of the elevator car is determined to be outside the zone; determine if at least one door is open; and stop the movement of the elevator car, if the position of the elevator car is determined to be outside the zone and the at least one door is open.

The zone may be an unlocking zone, wherein the unlocking zone is a zone extending from an upper limit above a floor level of a landing and a lower limit below the floor level of the landing, in which the elevator car floor is in order to enable at least one door to be unlocked.

The elevator control unit may be configured to obtain the indication that the elevator car is detected to arrive to a zone from the door zone sensor unit.

According to a third aspect, an elevator system for dynamically adjusting a levelling speed limit of an elevator car during a levelling operation is provided, wherein the elevator system comprising: at least one of the following: position sensor, drive, acceleration sensor, door zone sensor unit comprising at least one magnetic sensor; and an elevator control unit configured to: obtain an indication that the elevator car is detected to arrive to a zone; obtain at least one value indicating speed of the elevator car, in response to detecting that the elevator car arrives to the zone; and dynamically adjust the levelling speed limit of the elevator car based on the speed of the elevator car, wherein the elevator control unit and the at least one of the following: position sensor, drive, acceleration sensor, door zone sensor unit, are communicatively coupled to each other.

One advantage of the method, the elevator control unit, and the elevator system according to the invention is that the performance of Unintended Car Movement Protection (UCMP) may be improved at least partly with the dynamically adjusted levelling speed limit according to the invention compared to fixed levelling speed limits, because with the dynamically adjusted levelling speed limit according to the invention the elevator car may be stopped sooner, in which case the elevator car moves shorter distance away from the landing.

The method according to the invention helps at least partly to stop the elevator car within the predetermined distance from landing according to the UCMP.

Moreover, the method, the elevator control unit, and the elevator system according to the invention may even enable to prevent the elevator car from leaving the unlocking zone in case of sudden acceleration of the elevator car during the levelling operation. Especially, in a case where the elevator car for some reason starts to accelerate suddenly, when arriving to the landing, the dynamically adjusted levelling speed limit according to the invention may enable shorter reaction time compared to the fixed levelling speed limits. In some cases the fixed levelling speed limit may not be even met before the elevator car moves out of the unlocking zone. Alternatively or in addition, the method, the elevator control unit, and the elevator system according to the invention may even enable to prevent any danger or damage to a life, health or property being caused by sudden acceleration of the elevator car during the levelling operation. Based on at least the above mentioned advantages, the method according to the invention improves at least partly the safety of the elevator system.

The exemplary embodiments of the invention presented in this patent application are not to be interpreted to pose limitations to the applicability of the appended claims. The verb "to comprise" is used in this patent application as an open limitation that does not exclude the existence of also un-recited features. The features recited in depending claims are mutually freely combinable unless otherwise explicitly stated.

The expression "a number of" may herein refer to any positive integer starting from one (1).

The expression "a plurality of" may refer to any positive integer starting from two (2), respectively.

The novel features which are considered as characteristic of the invention are set forth in particular in the appended claims. The invention itself, however, both as to its construction and its method of operation, together with additional objectives and advantages thereof, will be best understood from the following description of specific embodiments when read in connection with the accompanying drawings.

BRIEF DESCRIPTION OF FIGURES

The embodiments of the invention are illustrated by way of example, and not by way of limitation, in the figures of the accompanying drawings.

DESCRIPTION OF SOME EMBODIMENTS

The embodiments of the invention may be implemented in an elevator system as will be described. The elevator system comprises an elevator car, a hoisting machine, an elevator control unit, and at least one of the following: position sensor, drive, acceleration sensor, door zone sensor unit. The hoisting machine is configured to drive the elevator car in an elevator shaft between a plurality of landings. The elevator unit and the at least one of the following: position sensor, drive, acceleration sensor, door zone sensor unit are communicatively coupled to each other. The communicatively coupling may be provided via an internal bus, for example. Preferably, the communicatively coupling may be provided via a serial bus.

Furthermore, the elevator system may comprise at least one magnet fixed to the elevator shaft. The at least one magnet may be floor magnet at a landing of the elevator shaft. Preferably, at least one floor magnet may be fixed to a landing door frame at each landing of the elevator shaft. Alternatively or in addition, the at least one magnet may be a terminal magnet at least at one terminal landing of the elevator shaft. The at least one terminal landing may be the top or the bottom floor. Alternatively or in addition, the at least one magnet may be a position magnet fixed to the elevator shaft for providing the position information of the elevator car in the shaft. The at least one magnet may comprise at least one passive RFID tag. The at least one RFID tag comprises unique identification code and type code of the at least one magnet. The type of the at least one magnet may be for example one of the following: floor magnet, terminal magnet, position magnet.

When the elevator car is configured to arrive to a desired landing, the speed of the elevator car is instructed to be decelerated so that the elevator car may be stopped at the landing. In order to improve the accuracy of the stopping of the elevator car to the landing a levelling operation is used. The levelling operation may be started, when the elevator car arrives to a zone. The zone may be an unlocking zone of the landing. The levelling operation may be provided each time when the elevator car is configured to arrive to one of the landings of the elevator shaft.

Figure 1:
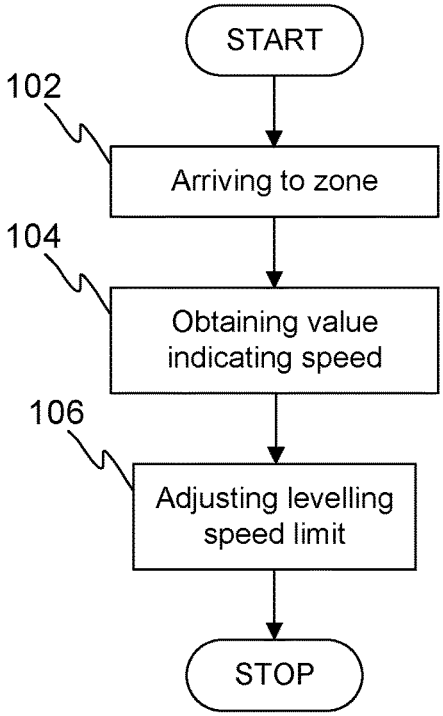
FIG. 1 illustrates schematically a method according to an embodiment of the invention.

FIG. 1 schematically illustrates a method for dynamically adjusting a levelling speed limit of an elevator car according to the invention as a flowchart. At the step 102, it is obtained an indication that the elevator car is detected to arrive to a zone. Within the zone the dynamic adjustment of the levelling speed limit is provided. In response to detecting that the elevator car arrives to the zone at least one value for indicating a speed of the elevator car is obtained at the step 104. Based on the speed of the elevator car, the levelling speed limit of the elevator car is dynamically adjusted at the step 106. Preferably, the dynamic adjustment of the levelling speed limit may be provided each time when the levelling operation is provided, i.e. when the elevator car is configured to arrive to one of the landings of the elevator shaft.

The zone, wherein the dynamic adjustment of the levelling speed limit may be provided may be the unlocking zone of the landing. The unlocking zone may be defined as a zone extending from an upper limit above the floor level of the landing and a lower limit below the floor level of the landing, in which the elevator car floor must be in order to enable the at least one door to be unlocked. Alternatively or in addition, the unlocking zone may be called as a door zone. Thus, the unlocking zone may further be defined as a zone extending from a lower limit below floor level of the landing to an upper limit above the floor level of the landing, in which the landing and car door equipment are in mesh and operable. The unlocking zone may be determined to be from −350 millimeters to +350 millimeters, for example. Preferably, the unlocking zone may be from −300 millimeters to +300 millimeters.

The elevator car may be detected to be in the unlocking zone, if the floor level of the elevator car is within the unlocking zone. The upper and lower limits of the unlocking zone are defined from the floor level of the landing, but a door operator for unlocking the at least one door may be located at the top of the at least one door. The landing door may be unlocked, when the car door coupler releases a lock of the landing door.

At the step 102, wherein it is obtained an indication that the elevator car is detected to arrive to a zone. The detection may be provided by means of the door zone sensor unit comprising at least one magnetic sensor and an RFID reader, for example. The door zone sensor unit is fixed to the elevator car. Preferably, the door zone sensor unit is fixed to the roof of the elevator car. The door zone sensor unit is further configured to provide an indication to the elevator control unit that that the elevator car is detected to arrive to a zone.

The position of the unlocking zone of each landing in the elevator shaft may be defined during a setup run. The setup run is performed before the elevator car may be taken into actual operation in order to provide pre-information about the elevator shaft. The setup run may be provided in connection with an installation of the elevator system, for example. During the setup run the elevator car may be configured to drive first either at the top floor or at the bottom floor and then the elevator car is configured to drive the elevator shaft from one end to the other end. The setup run may comprise obtaining and storing pre-information of the at least one magnet in the elevator shaft. For example the pre-information of the at least one floor magnet of unlocking zone of each landing of the elevator shaft may be obtained and stored during the setup run. The pre-information may be stored in a non-volatile memory of the elevator control unit. The pre-information may be obtained by the door zone sensor unit. The pre-information may comprise at least the following: floor number, identification code, magnet type, position information.

During the actual operation of the elevator car, such as driving the elevator car in the elevator shaft between landings, the door zone sensor unit is configured to detect that the elevator car arrives to the unlocking zone of the landing to which the elevator car is instructed to stop at the step 102. In other words the door control unit is configured to detect an identification code of at least one floor magnet and define based on the detected identification code and the corresponding stored pre-information that the detected at least one floor magnet is a floor magnet of the landing to which the elevator car is instructed to stop. The elevator control unit is configured to obtain an indication that the elevator car is detected to arrive to the unlocking zone in response to detection that the elevator car arrives to the unlocking zone from the door zone sensor unit. Alternatively or in addition, when the elevator car bypasses a position magnet the door zone sensor unit is configured to define the position information of the elevator car in the elevator shaft based on the detected identification code of the position magnet and the stored pre-information of the said position magnet. The defined position information may be used to define that the elevator car is approaching to the unlocking zone, if the position magnet is fixed in the elevator shaft proximity to the unlocking zone. Alternatively or in addition, the defined position information may be used to define that the elevator car is leaving from the unlocking zone, if the position magnet is fixed in the elevator shaft proximity to the unlocking zone.

During the levelling operation the elevator car is allowed to move within the unlocking zone with at least one open door, if the levelling speed of the elevator car is less than the levelling speed limit. The at least one open door may be an elevator car door or a landing door. The dynamic adjustment of the levelling speed limit is preferably provided when the at least one door is open.

The observation of the at least one value for indicating the speed of the elevator car may be started before the elevator arrives the unlocking zone. Preferably, the observation may be activated, when the elevator car arrives to the unlocking zone.

The speed of the elevator car may be obtained directly. Alternatively or in addition, the speed of the elevator car may also be obtained indirectly by obtaining, for example, the position of the elevator car as a value for indicating the speed of the elevator car. Alternatively or in addition, the speed of the elevator car may be determined and thus also the levelling speed limit of the elevator car may be adjusted based on a combination of a plurality of the obtained values for indicating the speed of the elevator car. As an example, the levelling speed limit may be adjusted based on the directly obtained speed of the elevator car in combination with the obtained position of the elevator car as a function of time. In case of dynamically adjusting the levelling speed based on the position of the elevator car also predetermined speed information of the elevator car at the said position of the elevator car may be utilized. The predetermined speed information may be based on expected deceleration rate of the elevator car, for example.

The at least one value for determining the speed of the elevator car may be obtained for example from at least one of the following: drive; position sensor; acceleration sensor; at least one magnetic sensor of a door zone sensor unit; which may be communicatively coupled to an elevator control unit. The speed of the elevator car may be determined in a drive by obtaining a signal from at least one encoder mounted in a hoisting motor and communicatively coupled to the drive. Alternatively or in addition, the speed of the elevator car may be determined based on a position of the elevator car obtained by means of at least one position sensor, such as absolute position sensor. The at least one position sensor may be fixed to the elevator car. Preferably, the position is obtained as a function of time. Alternatively or in addition, the speed of the elevator car may be determined within the unlocking zone in the door zone sensor unit comprising at least one magnetic sensor. Preferably the at least one magnetic sensor is a Hall sensor. The door zone sensor unit is coupled to the elevator car. Preferably, the door zone sensor unit is fixed to the roof of the elevator car. The at least one magnetic sensor of the door zone sensor unit may be configured to obtain a strength of a magnetic field as the elevator car is bypassing the at least one floor magnet at the unlocking zone of the landing. Based on the obtained magnetic field strength at least position and speed of the elevator car within the unlocking zone may be defined. For example, the speed of the elevator car may be defined from a rate of change of the position of the elevator car defined from the obtained strength of magnetic field as the elevator car bypasses the at least one floor magnet at the unlocking zone of the landing. The door zone sensor unit provides the position and speed of the elevator car only within the unlocking zone of each landing. The at least one floor magnet of the landing and the door zone sensor unit may be arranged so that the floor magnet of the landing and the door zone sensor unit are aligned, when the elevator car is exactly on the floor level of the landing. Alternatively or in addition, the speed of the elevator car may be determined on a basis of acceleration of the elevator car obtained by means of at least one acceleration sensor. The at least one acceleration sensor may be arranged in the door zone sensor unit, for example.

The dynamic adjustment of the levelling speed limit of the elevator may be understood so that the levelling speed limit is continuously adjusted during the levelling operation, while the elevator car is decelerating to the landing so that the levelling speed limit is reduced when the determined actual speed of the elevator car is decelerating. In other words, the speed of the elevator car is determined at a number of points during the levelling operation of the elevator car. The levelling speed limit may be adjusted at each point based on the speed of the elevator car determined at the point in question. Alternatively or in addition, the adjustment at each point may be based on the speed of the elevator car determined at the point in question together with the speed determined at the previous points. The adjustment may also be done only at some of the points. The points may be equally or logarithmically spaced, for example. For example, the door zone sensor unit may obtain the at least one value for indicating the speed of the elevator car 1000 times per second. Alternatively or in addition, the elevator control unit may be configured to obtain the value for indicating the speed of the elevator car 60 times per second. The dynamic adjustment may be finished when the movement of the elevator car is stopped. Alternatively, a minimum levelling speed limit may be determined and when the dynamically adjusted levelling speed meets the minimum levelling speed limit the dynamic adjustment may be finished.

Figure 2:
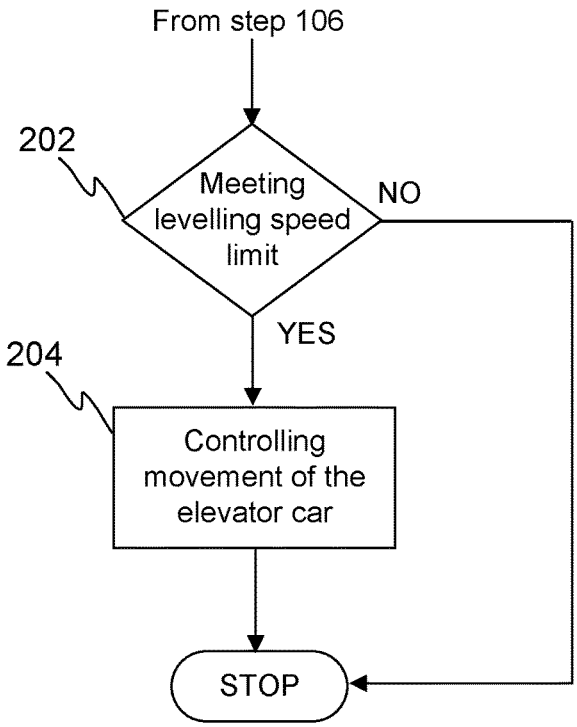
FIG. 2 illustrates schematically a method according to another embodiment of the invention.

The method according to the invention may further comprise determining if the speed of the elevator car meets the dynamically adjusted levelling speed limit of the elevator car at the step 202. If the speed of the elevator car meets the dynamically adjusted levelling speed limit of the elevator car, the movement of the elevator car is controlled at the step 204. This is schematically illustrated in FIG. 2. The movement of the elevator car is at least partly controlled by an elevator control unit. The controlling the movement of the elevator may comprise decelerating or stopping the movement of the elevator car. Deceleration is an operation of reducing the speed of the elevator car from normal operating speed to stop. Deceleration may also be referred to as slowdown.

Figure 3:
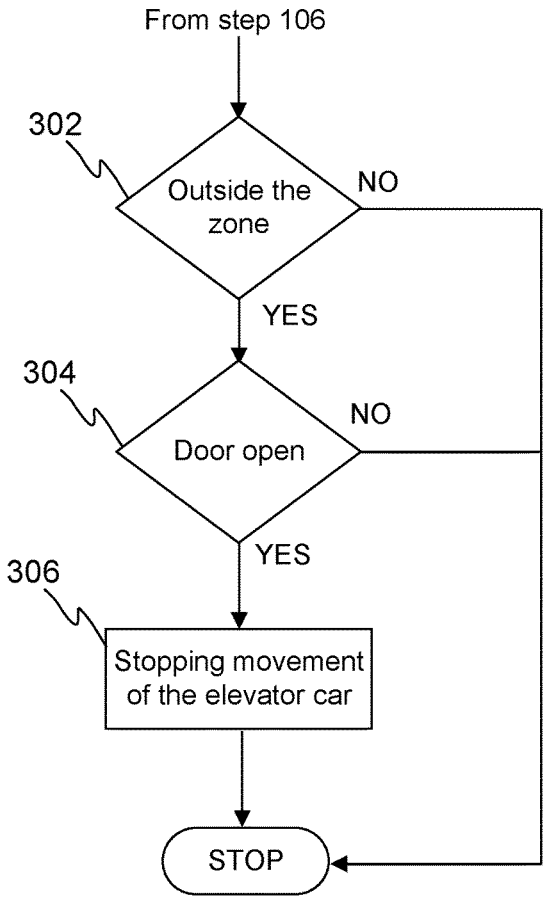
FIG. 3 illustrates schematically a method according to a third embodiment of the invention.

As described above, the at least one value for determining the speed of the elevator car may be the position of the elevator car. In that case, the method may also further comprise obtaining an indication if the position of the elevator car is determined to be outside the unlocking zone at the step 302. The indication that the elevator car is determined to be outside the unlocking zone may be obtained from the door zone sensor unit, for example. At the step 304 it is further determined if at least one door is open. If the position of the elevator car is determined to be outside the unlocking zone and the at least one door is open, the movement of the elevator car is stopped at the step 302. This is schematically illustrated in FIG. 3. The stopping of the elevator car is at least partly controlled by an elevator control unit. According to Unintended Car Movement Protection (UCMP) requirement the elevator car shall be stopped within a predetermined distance from a landing, if the elevator car moves away from the unlocking zone with open door(s), wherein the predetermined distance is 1000 mm.

Figure 4:
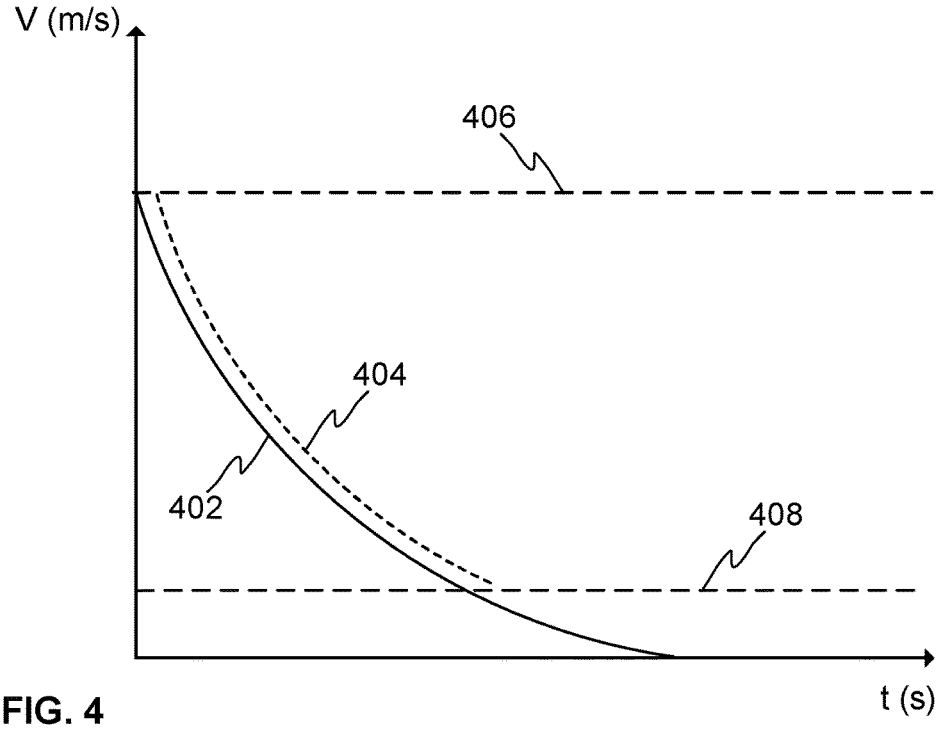
FIG. 4 illustrates an example of dynamically adjusted levelling speed limit obtained with a method according to the invention.

FIG. 4 illustrates an example of the dynamically adjusted levelling speed limit determined with the method according to the invention. On the x-axis of the FIG. 4 is time and on the y-axis is speed. The solid line 402 represents the actual speed of the elevator car. The dashed line 406 represents a fixed levelling speed limit that is presented as a comparison to the dynamically adjusted levelling speed limit. The dashed line 408, in turn, is a minimum levelling speed limit. The dense dashed line 404 is the dynamically adjusted levelling speed limit determined by the method according to the invention. FIG. 4 shows that the levelling speed limit is reduced while the elevator car speed is decelerating during the levelling operation. In the example presented in FIG. 4 the dynamic adjustment of the levelling speed limit of the elevator car is started when the elevator car arrives to the zone. The observation of the at least one value representing the speed of the elevator car may be started before the elevator car arrives to the zone. The dynamic adjustment of the levelling speed limit may be finished at a minimum levelling speed limit 408 in FIG. 4. Alternatively, the dynamic adjustment of the levelling speed limit may be continued until the elevator car is stopped to the landing.

In a case, where the speed of the elevator car for some reason starts to accelerate suddenly during the levelling operation, when the elevator car is arriving to the landing, the time for reacting to the acceleration with the dynamically adjusted levelling speed limit according to the invention may be shorter than with the fixed levelling speed limit. Thus, more time for controlling the elevator car may be obtained. The controlling may comprise for example decelerating the speed of the elevator car or stopping of the elevator car. For example, if the elevator car starts to accelerate right before stopping to the landing, with fixed levelling speed limit the elevator car may even leave the unlocking zone before the accelerated speed of the elevator car meets the fixed leveling speed limit. Furthermore, the accelerated speed of the elevator car may become so high that the elevator car may not be stopped or at least may be challenging to be stopped within the predetermined distance from the landing determined by the UCMP. However, with the dynamically adjusted levelling speed limit according to the invention the acceleration may be detected sooner, because the levelling speed limit is decreasing simultaneously, when the speed of the elevator car is decelerating. Thus, the dynamically adjusted levelling speed limit is closer to the speed of the elevator car than the fixed levelling speed limit at least when the speed of the elevator car starts to decelerate. The sudden acceleration or some other unusual movement of the elevator car may be, for example, a consequence of a failure occurring in the elevator control unit or in the drive, for example.

The dynamic adjustment of the levelling speed limit becomes more challenging, when the speed of the elevator car comes close to zero, because the inaccuracy in the determination of the speed of the elevator car based on the obtained at least one value for determining the speed of the elevator car may increase too much in order to determine reliable values for the dynamically adjusted levelling speed limit. Thus, a fixed minimum levelling speed limit 408 may be set for the dynamic adjustment of the levelling speed limit and below that the levelling speed limit is not dynamically adjusted any longer. Preferably, the minimum levelling speed limit 408 may be defined to be a maximum speed limit of the relevelling. The maximum speed limit of the relevelling may be 0.2 meters per second, for example.

According to an embodiment of the invention the levelling speed limit may be adjusted dynamically by obtaining the speed of the elevator car at a number of determination points, calculating average of the speed of the elevator car at the said number of observation points, and adding a fixed predetermined value to the calculated average. Alternatively or in addition, the observation points having highest and/or lowest speed may be excluded from the calculation of the average.

Alternatively or in addition, according to an embodiment of the invention the levelling speed limit may be adjusted dynamically by obtaining the speed of the elevator car at a number of observation points, calculating average of the speed of the elevator car at the observation points, and adding a predetermined percentage of the observed speed of the elevator car to the calculated average. Alternatively or in addition, the observation points having highest and/or lowest speed may be excluded from the calculation of the average.

Alternatively or in addition, the levelling speed limit may be adjusted based on expected or predetermined declaration rate of the elevator car.

Figure 5:
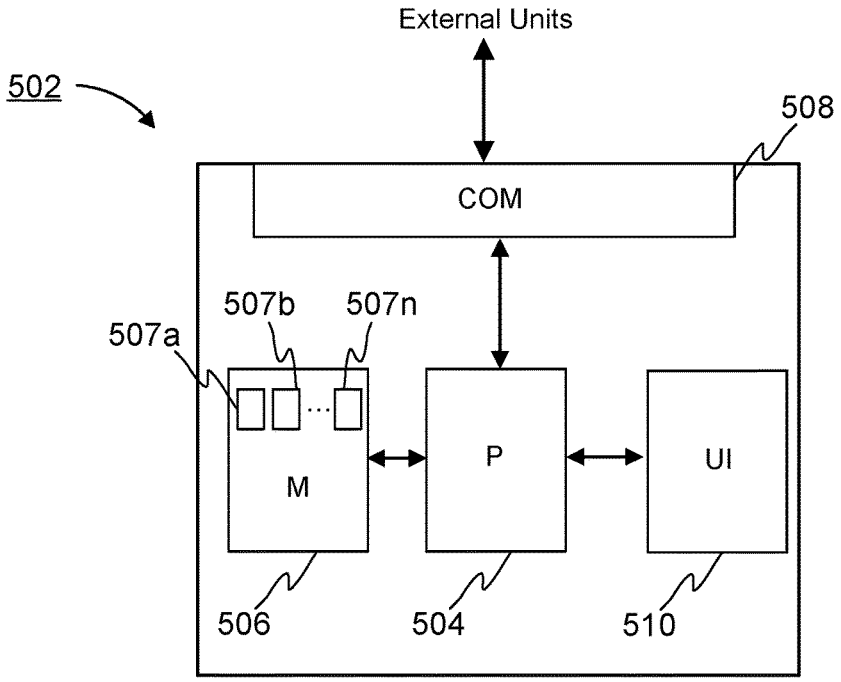
FIG. 5 illustrates schematically an example of the elevator control unit according to the invention.

A schematic example of the elevator control unit 502 according to the invention is disclosed in FIG. 5. The elevator control unit 502 may comprise one or more processors 504, one or more memories 506 being volatile or non-volatile for storing portions of computer program code 507*a*-507*n* and any data values, a communication interface 508 and possibly one or more user interface units 510. The mentioned elements may be communicatively coupled to each other with e.g. an internal bus. The communication interface 510 provides interface for communication with any external unit, such as position sensor, drive, acceleration sensor, door zone sensor unit, database and/or external systems. The communication interface 510 may be based on one or more known communication technologies, either wired or wireless, in order to exchange pieces of information as described earlier.

The at least one processor 504 of the elevator control unit 502 is at least configured to implement at least some method steps as described. The implementation of the method may be achieved by arranging the processor 504 to execute at least some portion of computer program code 507*a*-507*n* stored in the memory 506 causing the processor 504, and thus the elevator control unit 502, to implement one or more method steps as described. The processor 504 is thus arranged to access the memory 506 and retrieve and store any information therefrom and thereto. For sake of clarity, the processor 504 herein refers to any unit suitable for processing information and control the operation of the elevator control unit 502, among other tasks. The operations may also be implemented with a microcontroller solution with embedded software. Similarly, the memory 506 is not limited to a certain type of memory only, but any memory type suitable for storing the described pieces of information may be applied in the context of the present invention.

Figure 6:
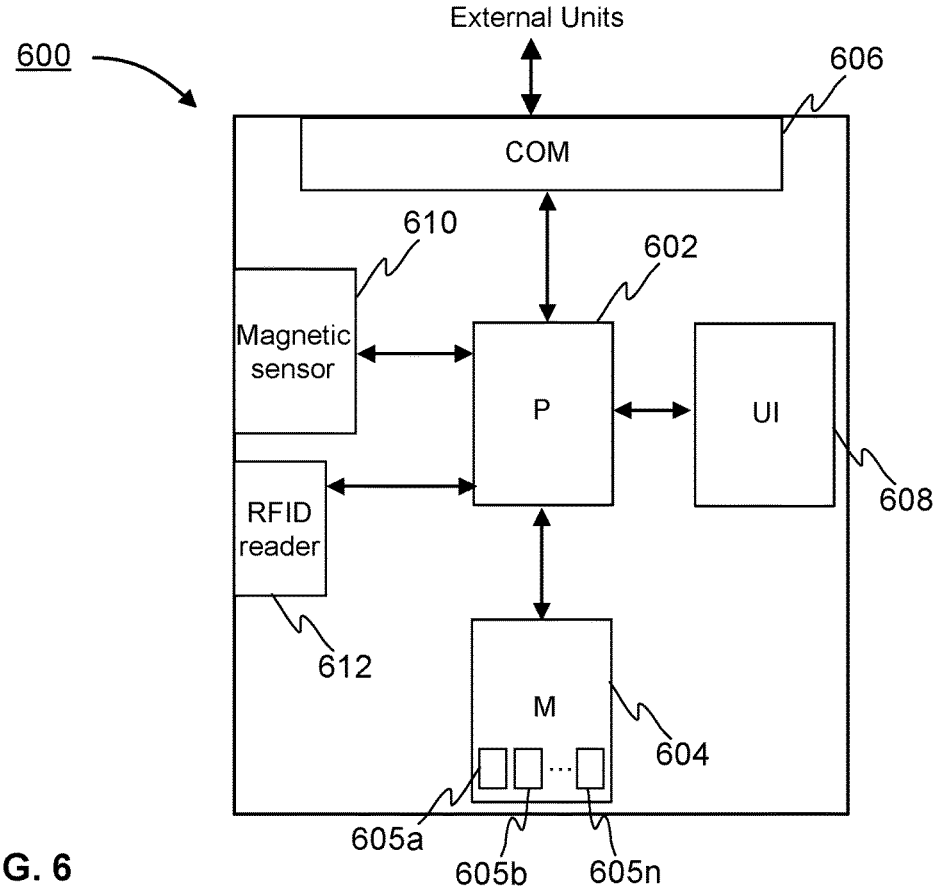
FIG. 6 illustrates schematically an example of the door zone sensor unit according to the invention.

A schematic example of the door zone sensor unit 600 according to the invention is disclosed in FIG. 6. The door zone sensor unit 600 may comprise at least one magnetic sensor 610, such as a Hall sensor, an RFID reader 612, one or more processors 602, one or more memories 604 being volatile or nonvolatile for storing portions of computer program code 605*a*-605*n* and any data values, a communication interface 606 and possibly one or more user interface units 608. The mentioned elements may be communicatively coupled to each other with e.g. an internal bus. The communication interface 606 provides interface for communication with any external unit, database and/or external systems. The communication interface 606 may be based on one or more known communication technologies, either wired or wireless, in order to exchange pieces of information as described earlier. The at least one magnetic sensor 610 may be an internal unit as is shown in FIG. 6. Alternatively or in addition, the at least one magnetic sensor 610 may be an external unit. Furthermore, the RFID reader 612 may be an internal unit of the door zone sensor unit 106. Alternatively or in addition, the RFID reader 612 may be an external unit.

The processor 602 of the door zone sensor unit 600 is at least configured to provide at least the following information within the unlocking zone of each landing: floor number, magnet type, identification code of the magnet, position of the elevator car, speed of the elevator car. The number of magnetic sensors 610 may be determined based on the number of the floor magnets at the unlocking zone of each landing. The RFID reader 612 of the door zone sensor unit 600 is configured to obtain at least the floor number, magnet type and identification code of the magnet from the RFID tag of the at least one floor magnet. The door zone information may be obtained only within the unlocking zone of each floor of the elevator shaft. The processor 602 is arranged to access the memory 604 and retrieve and store any information therefrom and thereto. For sake of clarity, the processor 602 herein refers to any unit suitable for processing information and control the operation of the door zone sensor unit, among other tasks. The operations may also be implemented with a microcontroller solution with embedded software. Similarly, the memory 604 is not limited to a certain type of memory only, but any memory type suitable for storing the described pieces of information may be applied in the context of the present invention.

The verb "meet" in context of a levelling speed limit is used in this patent application to mean that a predefined condition is fulfilled. For example, the predefined condition may be that the levelling speed limit value is reached and/or exceeded.

The specific examples provided in the description given above should not be construed as limiting the applicability and/or the interpretation of the appended claims. Lists and groups of examples provided in the description given above are not exhaustive unless otherwise explicitly stated.

The invention claimed is:

1. A method for dynamically adjusting a levelling speed limit of an elevator car during a levelling operation, the method comprising the steps of:

obtaining an indication that the elevator car is detected to arrive to a zone;

obtaining at least one value indicating the speed of the elevator car, in response to detecting that the elevator car is arriving to the zone; and dynamically adjusting the levelling speed limit of the elevator car based on the speed of the elevator car, wherein the speed of the elevator car is determined at a number of points during the levelling operation of the elevator car, and the levelling speed limit is adjusted at each point based on the speed of the elevator car determined at the respective point.

2. The method according to claim 1, wherein the at least one value for indicating the speed of the elevator car is obtained from at least one of the following: position sensor, drive, acceleration sensor, a magnetic sensor of door zone sensor unit.

3. The method according to claim 2, further comprising the steps of:

determining if the speed of the elevator car meets the dynamically adjusted levelling speed limit of the elevator car; and controlling the movement of the elevator car, if the speed of the elevator car is determined to meet the dynamically adjusted levelling speed limit of the elevator car.

4. The method according to claim 2, wherein the at least one value indicating the speed of the elevator car is a position of the elevator car and the method further comprises the steps of:

obtaining an indication if the position of the elevator car is determined to be outside the zone;

determining if at least one door is open; and stopping the movement of the elevator car, if the position of the elevator car is determined to be outside the zone and the at least one door is determined to be open.

5. The method according to claim 2, wherein the zone is an unlocking zone, and wherein the unlocking zone is a zone extending from an upper limit above a floor level of a landing and a lower limit below the floor level of the landing, in which the elevator car floor is in order to enable at least one door to be unlocked.

6. The method according to claim 1, further comprising the steps of:

determining if the speed of the elevator car meets the dynamically adjusted levelling speed limit of the elevator car; and controlling the movement of the elevator car, if the speed of the elevator car is determined to meet the dynamically adjusted levelling speed limit of the elevator car.

7. The method according to claim 6, wherein the at least one value indicating the speed of the elevator car is a position of the elevator car and the method further comprises the steps of:

obtaining an indication if the position of the elevator car is determined to be outside the zone;

determining if at least one door is open; and stopping the movement of the elevator car, if the position of the elevator car is determined to be outside the zone and the at least one door is determined to be open.

8. The method according to claim 6, wherein the zone is an unlocking zone, and wherein the unlocking zone is a zone extending from an upper limit above a floor level of a landing and a lower limit below the floor level of the landing, in which the elevator car floor is in order to enable at least one door to be unlocked.

9. The method according to claim 1, wherein the at least one value indicating the speed of the elevator car is a position of the elevator car and the method further comprises the steps of:

obtaining an indication if the position of the elevator car is determined to be outside the zone;

determining if at least one door is open; and stopping the movement of the elevator car, if the position of the elevator car is determined to be outside the zone and the at least one door is determined to be open.

10. The method according to claim 9, wherein the zone is an unlocking zone, and wherein the unlocking zone is a zone extending from an upper limit above a floor level of a landing and a lower limit below the floor level of the landing, in which the elevator car floor is in order to enable at least one door to be unlocked.

11. The method according to claim 1, wherein the zone is an unlocking zone, and wherein the unlocking zone is a zone extending from an upper limit above a floor level of a landing and a lower limit below the floor level of the landing, in which the elevator car floor is in order to enable at least one door to be unlocked.

12. The method according to claim 1, wherein the indication that the elevator car is detected to arrive to the zone is obtained from a door zone sensor unit.

13. The method according to claim 1, wherein the levelling speed limit is continuously adjusted during the levelling operation.

14. An elevator controller for dynamically adjusting a levelling speed limit of an elevator car during a levelling operation, the elevator control unit comprising:

at least one processor; and at least one memory storing at least one portion of computer program code, wherein the at least one processor is configured to cause the elevator control unit at least to:

obtain an indication that the elevator car is detected to arrive to a zone;

obtain at least one value indicating speed of the elevator car, in response to detecting that the elevator car is arriving to the zone; and dynamically adjust the levelling speed limit of the elevator car based on the speed of the elevator car, wherein the speed of the elevator car is determined at a number of points during the levelling operation of the elevator car, and the levelling speed limit is adjusted at each point based on the speed of the elevator car determined at the respective point.

15. The elevator controller according to claim 14, wherein the at least one value indicating the speed of the elevator car is obtained from at least one of the following: position sensor; drive; acceleration sensor; magnetic sensor of door zone sensor unit; which is communicatively coupled to the controller.

16. The elevator controller according to claim 14, wherein the elevator controller is further configured to:

determine if the speed of the elevator car meets the dynamically adjusted levelling speed limit of the elevator car; and control the movement of the elevator car, if the speed of the elevator car is determined to meet the dynamically adjusted levelling speed limit of the elevator car.

17. The elevator controller according to claim 14, wherein the at least one value indicating the speed of the elevator car is a position of the elevator car and the elevator controller is further configured to:

obtain an indication if the position of the elevator car is determined to be outside the zone;

determine if at least one door is open; and stop the movement of the elevator car, if the position of the elevator car is determined to be outside the zone and the at least one door is open.

18. The elevator controller according to-claim 14, wherein the zone is an unlocking zone, and wherein the unlocking zone is a zone extending from an upper limit above a floor level of a landing and a lower limit below the floor level of the landing, in which the elevator car floor is in order to enable at least one door to be unlocked.

19. The elevator controller according to claim 14, wherein the indication that the elevator car is detected to arrive to the zone is obtained from a door zone sensor unit.

20. An elevator system for dynamically adjusting a levelling speed limit of an elevator car during a levelling operation, the elevator system comprising:

at least one of the following: position sensor, drive, acceleration sensor, door zone sensor unit comprising at least one magnetic sensor; and an elevator controller configured to:

obtain an indication that the elevator car is detected to arrive to a zone;

obtain at least one value indicating speed of the elevator car, in response to detecting that the elevator car arrives to the zone; and dynamically adjust the levelling speed limit of the elevator car based on the speed of the elevator car, wherein the elevator controller and the at least one of the following: position sensor, drive, acceleration sensor, door zone sensor unit, are communicatively coupled to each other, and wherein the speed of the elevator car is determined at a number of points during the levelling operation of the elevator car, and the levelling speed limit is adjusted at each point based on the speed of the elevator car determined at the respective point.

* * * * *